US007303228B1

(12) United States Patent
Thomas

(10) Patent No.: US 7,303,228 B1
(45) Date of Patent: Dec. 4, 2007

(54) FOLDABLE BENCH

(76) Inventor: John S. Thomas, 703 W. Johnson St., Raleigh, NC (US) 27603

( * ) Notice: Subject to any disclaimer, the term of this patent is extended or adjusted under 35 U.S.C. 154(b) by 324 days.

(21) Appl. No.: 11/055,224

(22) Filed: Feb. 10, 2005

Related U.S. Application Data

(63) Continuation-in-part of application No. 10/659,236, filed on Sep. 9, 2003, now Pat. No. 6,854,797.

(60) Provisional application No. 60/409,538, filed on Sep. 9, 2002.

(51) Int. Cl.
*A47C 4/00* (2006.01)

(52) U.S. Cl. ..... 297/16.1; 297/16.2; 297/25; 297/42; 297/51; 297/53; 297/54

(58) Field of Classification Search ..... 297/16.1, 297/16.2, 25, 42, 51, 53, 54
See application file for complete search history.

(56) References Cited

U.S. PATENT DOCUMENTS

| | | | |
|---|---|---|---|
| 191,015 | A | 5/1877 | Webb |
| 245,903 | A | 8/1881 | White |
| 345,454 | A | 8/1886 | Baldwin |
| 383,255 | A | 5/1888 | Spaet et al. |
| 1,531,837 | A | 3/1925 | Otto Boldin |
| 1,952,610 | A | 3/1934 | Shearer |
| 2,417,439 | A | 3/1947 | Overdick |
| 2,483,309 | A | 9/1949 | Amaducci |
| 2,566,818 | A | 9/1951 | Babit |
| 2,887,149 | A | 5/1959 | Cassin |
| 3,822,913 | A | 7/1974 | Raver |
| 4,034,684 | A | 7/1977 | Carson et al. |
| 4,061,305 | A | 12/1977 | Beekenkamp |
| 4,245,849 | A | 1/1981 | Thiboutot |
| 4,278,243 | A | 7/1981 | Alessio |
| 4,406,495 | A | 9/1983 | Turner |
| 4,617,869 | A | 10/1986 | Denomey |
| 4,699,422 | A | 10/1987 | Yamasaki |
| 4,868,676 | A | 9/1989 | Matsuura et al. |
| 4,960,277 | A | 10/1990 | LaRossa et al. |
| 5,058,948 | A | 10/1991 | Singer |
| 5,058,950 | A | 10/1991 | Mann |
| 5,080,024 | A | 1/1992 | Yamamoto |
| 5,394,810 | A | 3/1995 | Howard et al. |
| 5,882,283 | A | 3/1999 | Stevens |
| 5,908,182 | A | 6/1999 | Stang et al. |

(Continued)

FOREIGN PATENT DOCUMENTS

| | | | |
|---|---|---|---|
| CH | 683311 | A5 | 2/1994 |

(Continued)

*Primary Examiner*—Rodney B. White
(74) *Attorney, Agent, or Firm*—Coats & Bennett, P.L.L.C.

(57) ABSTRACT

A foldable bench having at least a pair of seat sections pivotally connected together. Pivotally mounted to the other side of each seat section is a leg assembly that is movable from a folded position to an extended position. When the bench assumes an unfolded position a strut extends from a point to a respective leg assembly and when the bench carries a load each strut is held in compression. An interconnecting member connects the two leg assemblies and is generally held in tension when the bench assumes an unfolded position and carries a load.

6 Claims, 11 Drawing Sheets

U.S. PATENT DOCUMENTS

| | | | | |
|---|---|---|---|---|
| 5,993,360 | A | 11/1999 | Stevens | |
| 6,161,486 | A | 12/2000 | Boots | |
| 6,182,724 | B1 | 2/2001 | Chou et al. | |
| 6,254,177 | B1 | 7/2001 | Tseng | |
| 6,264,586 | B1 | 7/2001 | Webber | |
| 6,299,251 | B1 | 10/2001 | Harper | |
| 6,340,205 | B1 | 1/2002 | Battiston | |
| 6,550,855 | B2 | 4/2003 | Liu | |
| 6,854,797 | B1 * | 2/2005 | Thomas | 297/16.1 |
| 7,121,620 | B1 * | 10/2006 | Fang | 297/51 |
| 2003/0020305 | A1 | 1/2003 | Liu | |

FOREIGN PATENT DOCUMENTS

| | | | |
|---|---|---|---|
| EP | 52031 | A1 | 5/1982 |
| GB | 2074853 | A | 11/1981 |
| GB | 2192534 | A | 1/1988 |

* cited by examiner

FOLDABLE BENCH

CROSS REFERENCE TO RELATED APPLICATIONS

This application claims priority under 35 U.S.C. § 119(e) from the following U.S. provisional application: Application Ser. No. 60/409,538 filed on Sep. 9, 2002. That application is incorporated in its entirety herein. Furthermore, this is a continuation-in-part of U.S. patent application Ser. No. 10/659,236 filed on Sep. 9, 2003, now U.S. Pat. No. 6,854,797 B2.

BACKGROUND OF THE INVENTION

Athletic benches are widely used in a variety of sports ranging from football to soccer. Usually, athletic benches, or benches occupied by players during the course of an athletic contest, come in different sizes and designs. Many such benches are made of wood or metal. However, most athletic or player benches share one common characteristic. They are usually large and far from portable. Such conventional player benches are generally functional. But their size and weight restrict their use to essentially one location.

Certain athletic fields such as soccer fields or baseball fields typically used by children or young adults are not provided with player benches. Thus, those players not actually participating usually stand or kneel on the sidelines. This is not an ideal situation, especially for players taking a break from the athletic action.

Therefore, there has been and continues to be a need for a foldable bench that can be folded and carried from on location to another.

SUMMARY OF THE INVENTION

The present invention entails a foldable bench having at least two seat sections and an underlying support structure. The underlying support structure includes at least two leg assemblies that are foldable from a folded or retracted position to an extended position. In the extended position the leg assemblies are interconnected by a pair of connectors. Further, the leg assemblies are interconnected by a cable or other interconnecting member.

In one embodiment, when the foldable bench assumes an erect and unfolded position, the connectors extending between the bench and the leg assemblies are maintained in compression while the cable or interconnecting member extended between the leg assemblies is maintained in tension.

In another embodiment, the leg assemblies are connected to the respective seat sections such that during the folding process the connection point between the leg assemblies and the seat section moves. That is, there is provided at least one connecting point between a respective leg assembly and a respective seat section and as the bench is folded the connecting point slides with respect to the seat section.

Other objects and advantages of the present invention will become apparent and obvious from a study of the following description and the accompanying drawings, which are merely illustrative of such invention.

DESCRIPTION OF THE INVENTION

Figure 1:
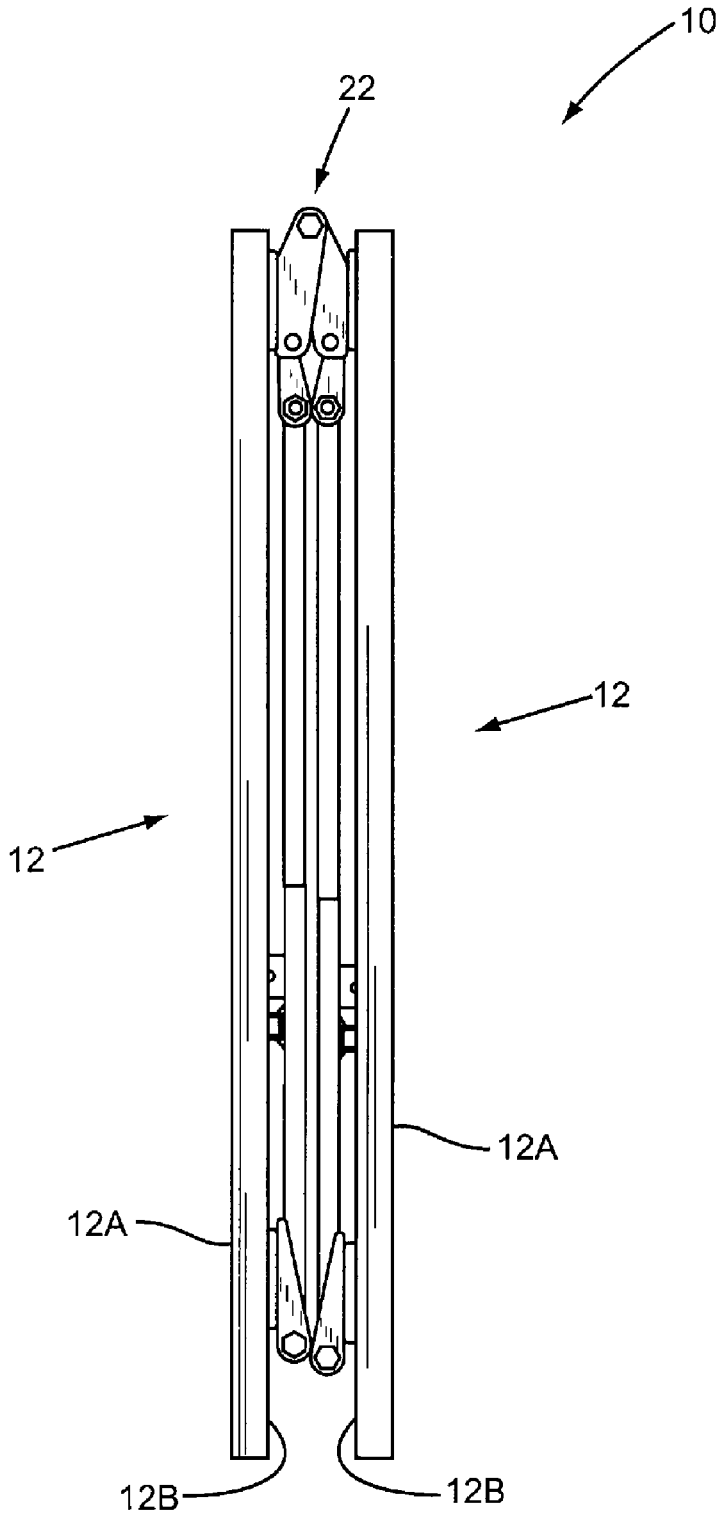
FIG. 1 is a side elevational view of the foldable bench shown in a folded position.

With further reference to the drawings, the foldable bench of the present invention is shown therein and indicated generally by the numeral 10. As will be appreciated from subsequent portions of this disclosure, the foldable bench 10 is adapted to assume a folded position, as shown in FIG. 1, or an unfolded or erect position as shown in FIG. 2.

Viewing the foldable bench 10 in more detail, the same includes a pair of seat sections, each seat section being indicated generally by the numeral 12. It should be appreciated that the foldable bench 10 could include any number of seat sections 12 but in the case of the embodiment illustrated herein, the foldable bench includes two seat sections. Each seat section includes a top 12A and a bottom 12B. Seat sections 12, and other portions of the foldable bench 10, can be constructed of various materials such as plastic, wood, metal, fiberglass, etc.

Figure 2:
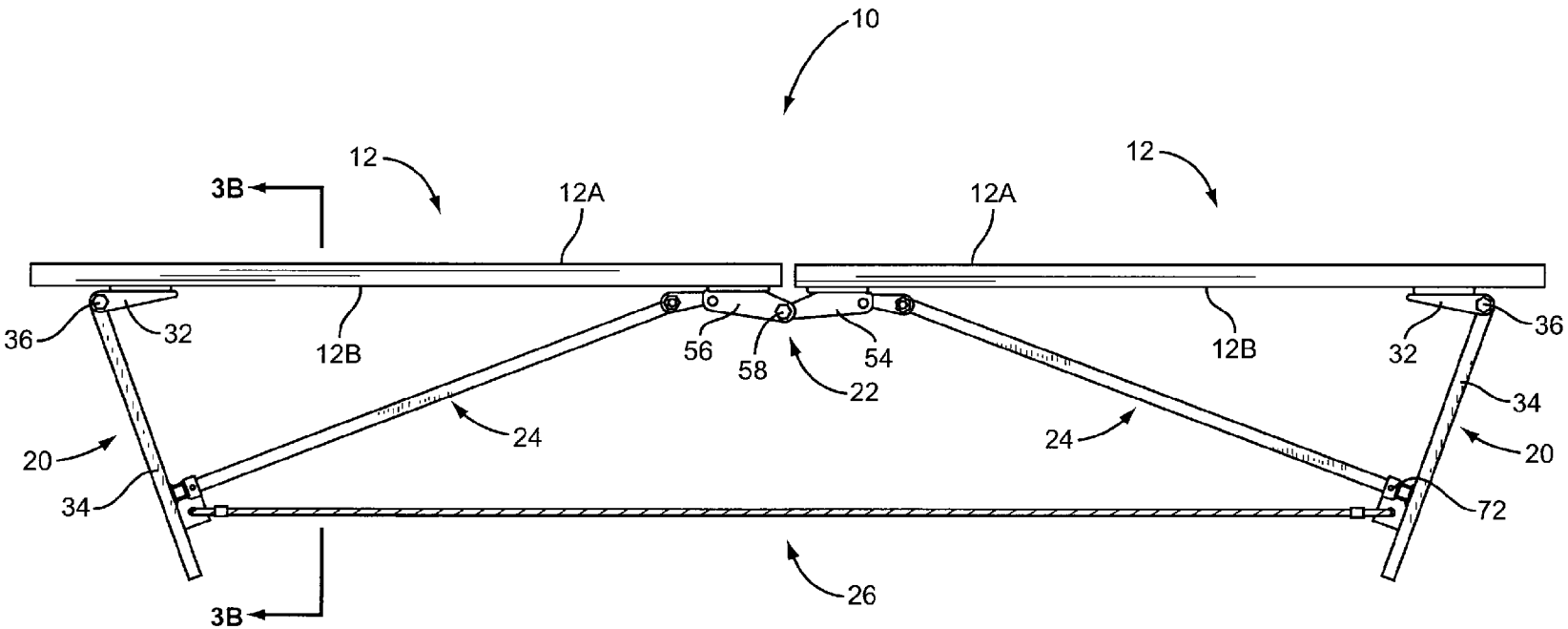
FIG. 2 is a side elevational view of the foldable bench shown in an unfolded and erect position.
Figure 3A:
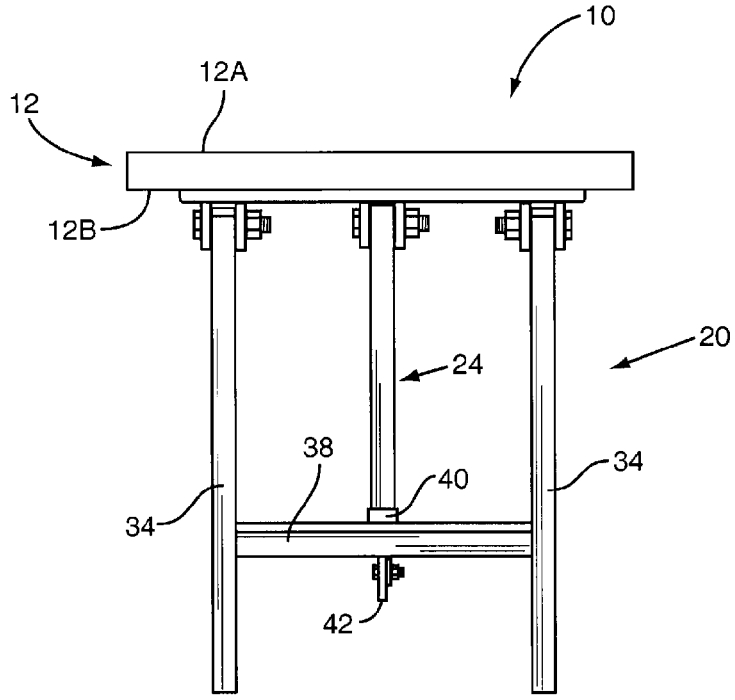
FIG. 3A is an end elevational view of the bench.
Figure 3B:
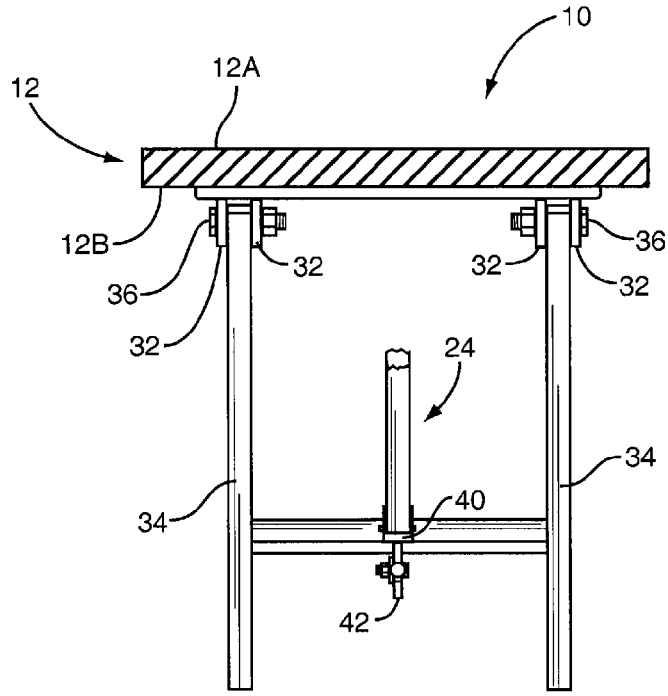
FIG. 3B is a sectional view of the lines 3B-3B of FIG. 2.

To support the foldable bench 10 when the same assumes the unfolded or erect position shown in FIG. 2, there is provided an underlying support structure. This underlying support structure includes a pair of leg assemblies of 20, each leg assembly being foldable and mounted to the underside 12B about the outboard portion of each seat section 12. Connected between the inboard portions of the seat sections 12 is a hinge assembly 22. As will be appreciated from subsequent portions of the disclosure, the hinge assembly 22 permits the seat sections to be folded back-to-back as shown in FIG. 1 or to be extended to where the seat sections lie end-to-end and generally within the same plane. A strut or first connector indicated generally by the numeral 24 is connected between each leg assembly 20 and the hinge assembly 22. As will be appreciated subsequent herein, when the foldable bench 10 is unfolded and assumes the erect position of FIG. 2, the individual connectors 24 are in compression when a load is applied to the erected bench 10. In addition, a cable or interconnecting member 26 is connected between the leg assemblies 20. In a preferred embodiment, the interconnecting member assumes the form of a flexible cable 26. However, it is appreciated that the interconnecting member 26 could simply be a rigid rod, shaft or even a telescoping member.

With reference to FIGS. 3A-4B, the leg assembly 20 is shown in more detail therein. Each leg assembly mounted to the outboard end of a seat section 12 includes a bracket or mounting plate 30 that is secured to the underside of a respective seat section by bolts, screws or other suitable means. Formed on each side of the bracket is pair of spaced apart gussets 32. A leg 34 is pivotally mounted between each pair of gussets 32 by a pivot pin 36. In the case of the present embodiment, pivot pin 36 assumes the form of a bolt and nut assembly. Extending across and between the legs 34 is a cross member 38. Secured or formed on the inside of the cross member 34 is a stub sleeve 40 that as will be understood later, functions to connect to one end of the connectors 24. Extending from the central portion of the cross member 38 is a tab 42 that is adapted to connect to one end of the cable 26.

Figure 4A:
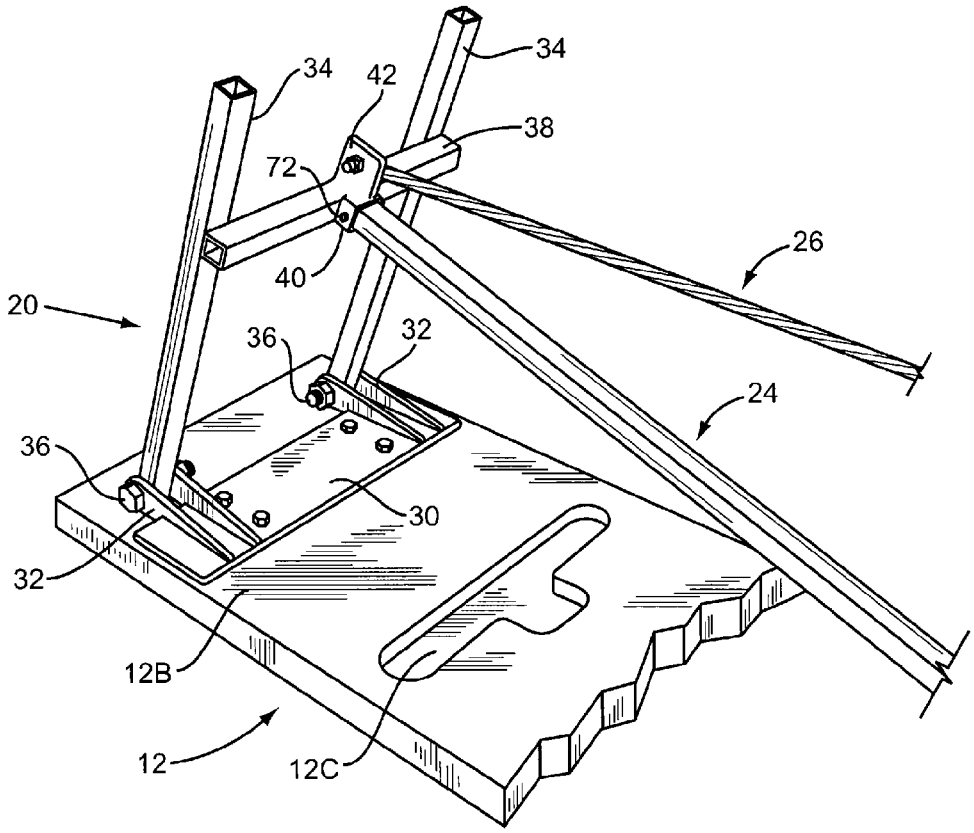
FIG. 4A is a fragmentary perspective view showing the underside of a portion of a foldable bench in an erect posture.
Figure 4B:
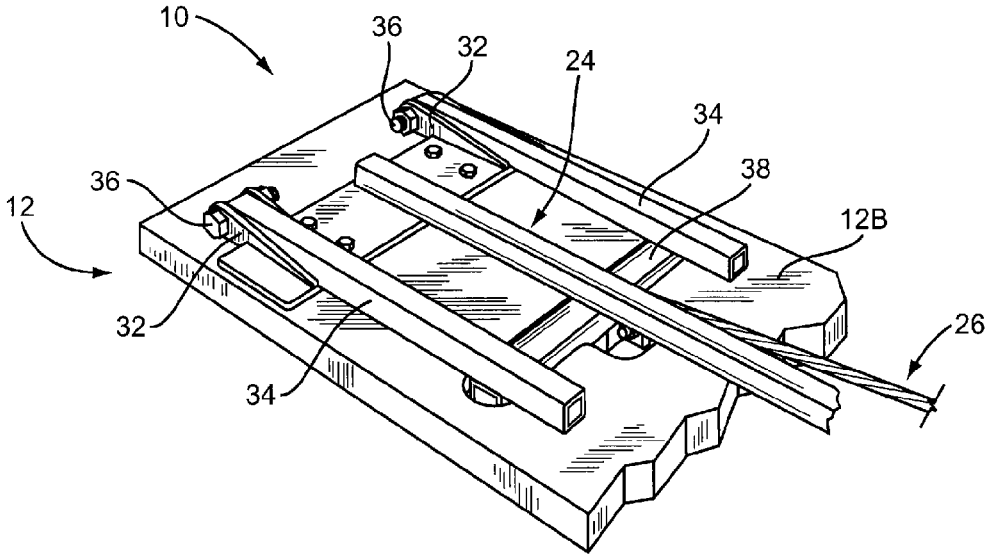
FIG. 4B is a fragmentary perspective view of a portion of the foldable bench shown in a folded position.

As seen in FIGS. 4A and 4B, the entire leg assembly 20 can be pivoted via the pivot pins 36 from an extended position (FIG. 4A) and a retracted or folded position (FIG. 4B).

Figure 5:
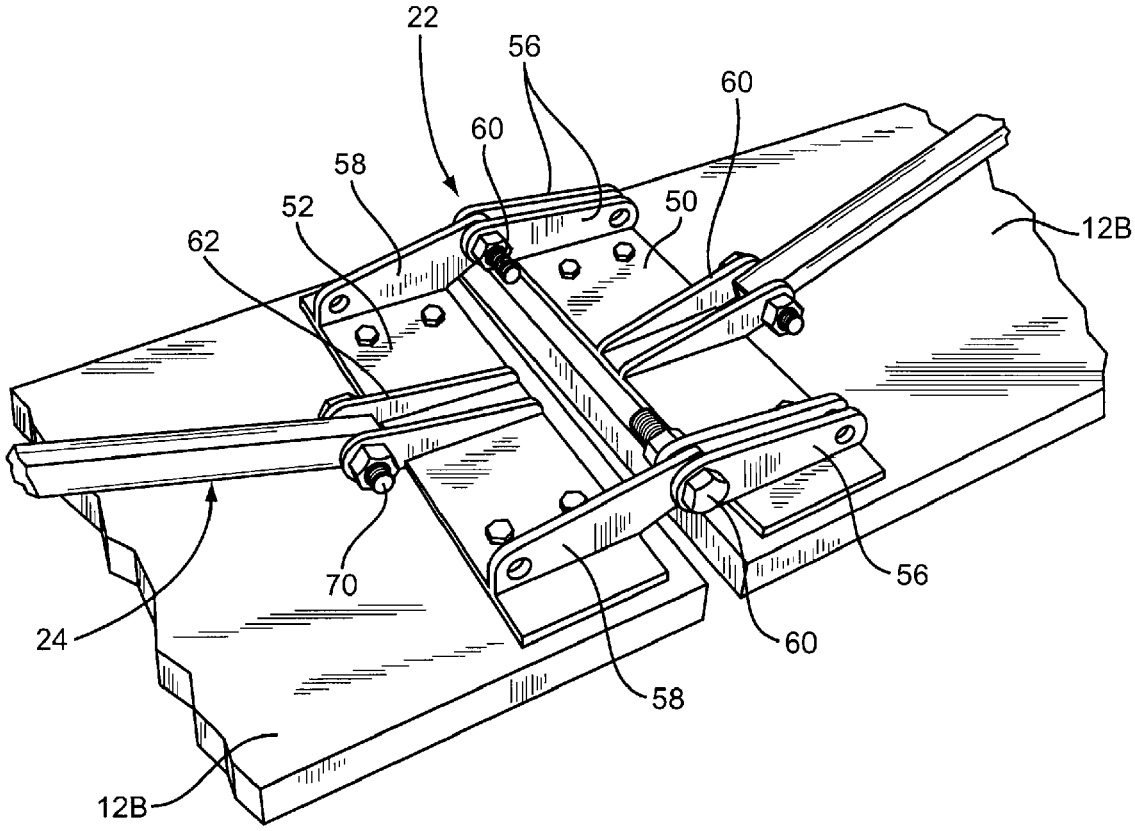
FIG. 5 is a perspective view of an underside portion of the foldable bench illustrating the hinge structure interconnecting two seat sections.

With specific reference to FIGS. 2 and 5, the hinge 22 for connecting the seat sections 12 is shown. Hinge 22 includes a pair of brackets 50 and 52, each bracket being secured to the underside 12B of a respective seat section about an inboard end. One of the brackets, in this case, bracket 50 includes two sets of hinge fingers, with each hinge finger being referred to by the numeral 56. On the other bracket 52, there is provided a pair of spaced apart hinge fingers 58. A seen in FIG. 5, the single hinge fingers 58 project into and between a pair of the hinge fingers 56 formed on the opposite bracket 50. All of the hinge fingers 56 and 58 includes openings for receiving a pivot pin 60. In this case, each pivot pin 60 includes a bolt and nut assembly.

Therefore, it is seen that the seat sections 12 can be pivoted about the axis of the two pivot pins 60. In one configuration, the foldable bench assumes a folded position (FIG. 1), and in another configuration the bench sections 12 assume an extended position and wherein, as viewed in FIG. 2, the hinge assembly 22 also is extended.

Finally, each of the brackets 50 and 52 of the hinge assembly include a pair of connector gussets 62. As seen in FIG. 5, each pair or set of connector gussets 62 is generally centrally located with each gusset including an opening formed in the outer terminal end.

Pivotally connected to the connector gussets 66 is the connector 24. A pivot pin 70 in the form of a bolt and nut assembly is extended through the openings within the terminal ends of the gussets 62 and through an opening in one end portion of the connector 24. The other end of the connector 24 is adapted to be inserted into the stub sleeve 40 of one of the leg assemblies 20. This is particularly illustrated in FIG. 4A. When the foldable bench 10 assumes the unfolded or erect position, it is desirable to lock or secure each connector 24 to a respective leg assembly 20. Therefore, there is provided a locking pin or screw 72 that is adapted to be secured to both the outer end of each connector 24 and a respective stub sleeve 40. The locking pins or screws 72 can be easily and quickly attached and detached to facilitate the folding of the bench 10.

Further, the leg assemblies 20, in an erect position, are interconnected by a cable 26. It is noted that the cable 26 is secured to the leg 20 by connecting to the tabs 42 extending from the cross member 38. Cable 26 can be connected to the tabs in various ways. For example, the opposed terminals ends of the cable 26 can be secured to a bolt assembly which is in turn connected to an opening formed in the tab 42.

In the folded position, as seen in FIGS. 1 and 4B, the leg assemblies 20 are rotated to where the legs 34 point towards the hinge assembly 22. The underside of each seat section 12 includes a recess or cavity 12C that receives a portion of the leg assembly 24. In the case of the embodiment illustrated herein, the recess or cut-out 12C is particularly adapted to receive at least a portion of the cross member 38 and the stub sleeve 40 and tab 42 that are associated with the cross member 38. This tends to make the bench 10 more compact when the same assumes the folded position.

When the bench 10 is extended to its erect position shown in FIG. 2, it is appreciated that the length of the connectors 24 and the cable 26 is calculated so as to result in the legs of the leg assemblies being directed inwardly at an angle. That is, in the preferred embodiment, the leg assemblies 20 and particularly the legs 34 thereof are not disposed perpendicular to the seat sections 12 but are disposed at an angle as illustrated in FIG. 2. While this angle may vary, in one exemplary configuration, the legs 34 form an angle of approximately 20 degrees with respect to a reference line that extends through the pivot pins 36 and normal to the seat sections 12. It is contemplated that the angle of the legs 34 with respect to the reference line could vary from 10 to 20 degrees. Further, each strut or connector 24 would preferably extend generally normal to the attached leg assembly 20. That is, each strut or connector 24 would form a generally right angle with respect to the leg assembly 20.

Further, when the foldable bench 10 is disposed in the erect position shown in FIG. 2, and a load is placed on the bench 10, the connectors 24 are generally held in compression. Cable 26, on the other hand, is maintained in tension and thus prevents the legs from rotating outwardly in response to a load being placed on the bench.

Finally, the foldable bench 10 may assume various configurations and designs. In one particular embodiment, the interconnecting member 26, as discussed above, could be in the form of a cable and the cable could be utilized as a carrying strap for the entire bench 10 when the same assumes the folded configuration. Additionally, in the embodiments illustrated herein, the bench is shown as including two seat sections 12. However, it will be appreciated that the foldable bench 10 could include more than two foldable sections.

Figure 6:
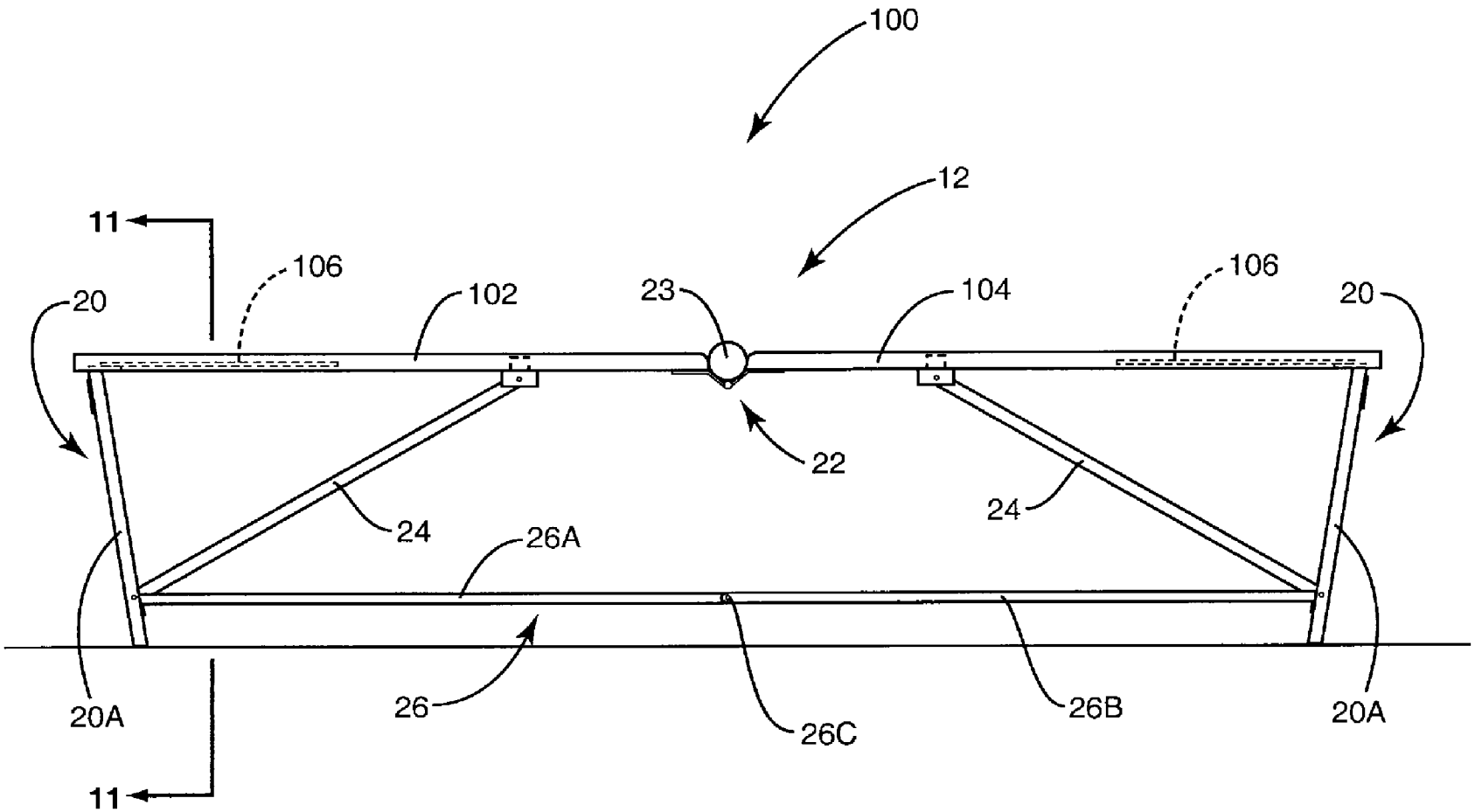
FIG. 6 is a side elevational view of a second design for the foldable bench of the present invention.
Figure 8:
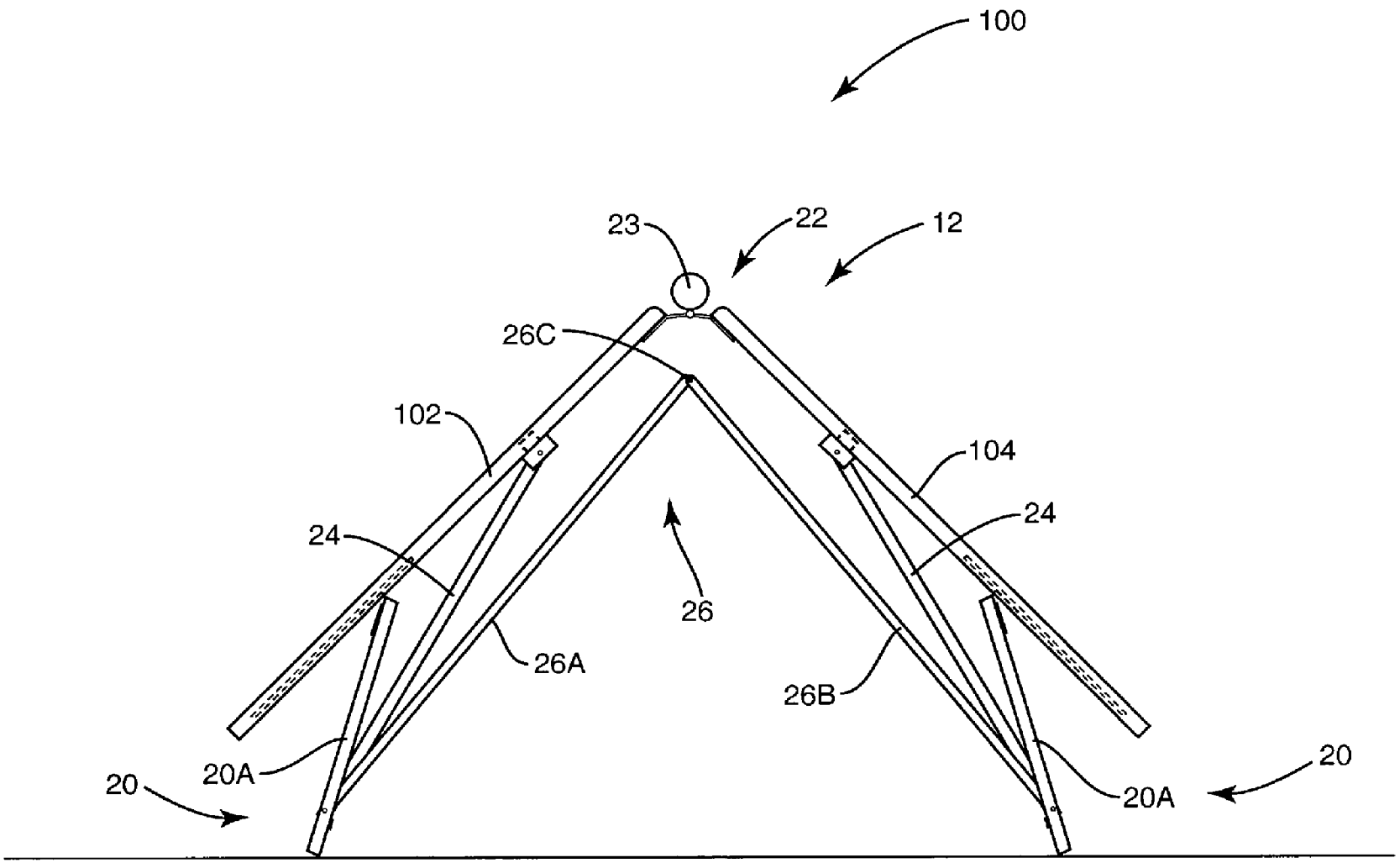
Figure 9:
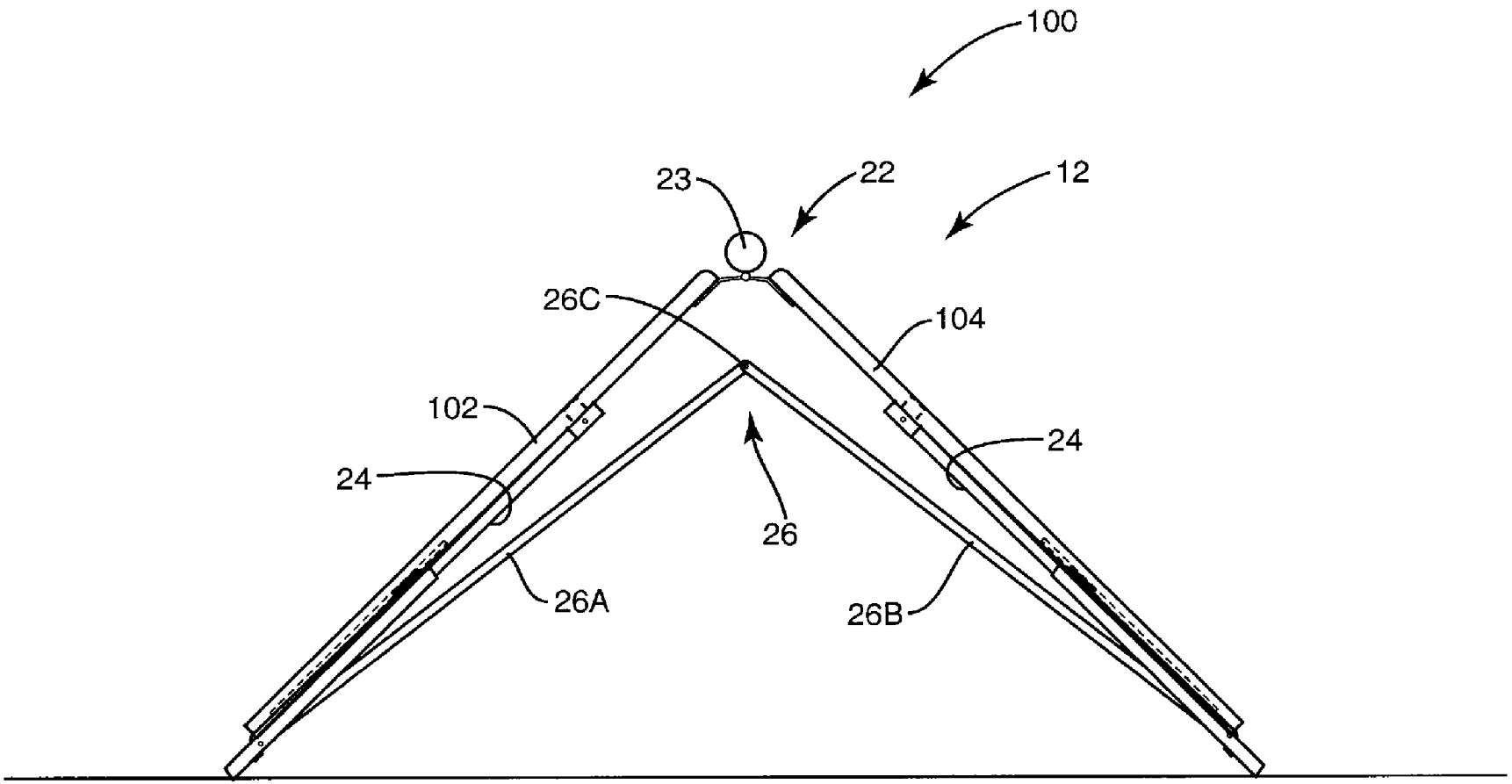
Figure 10:
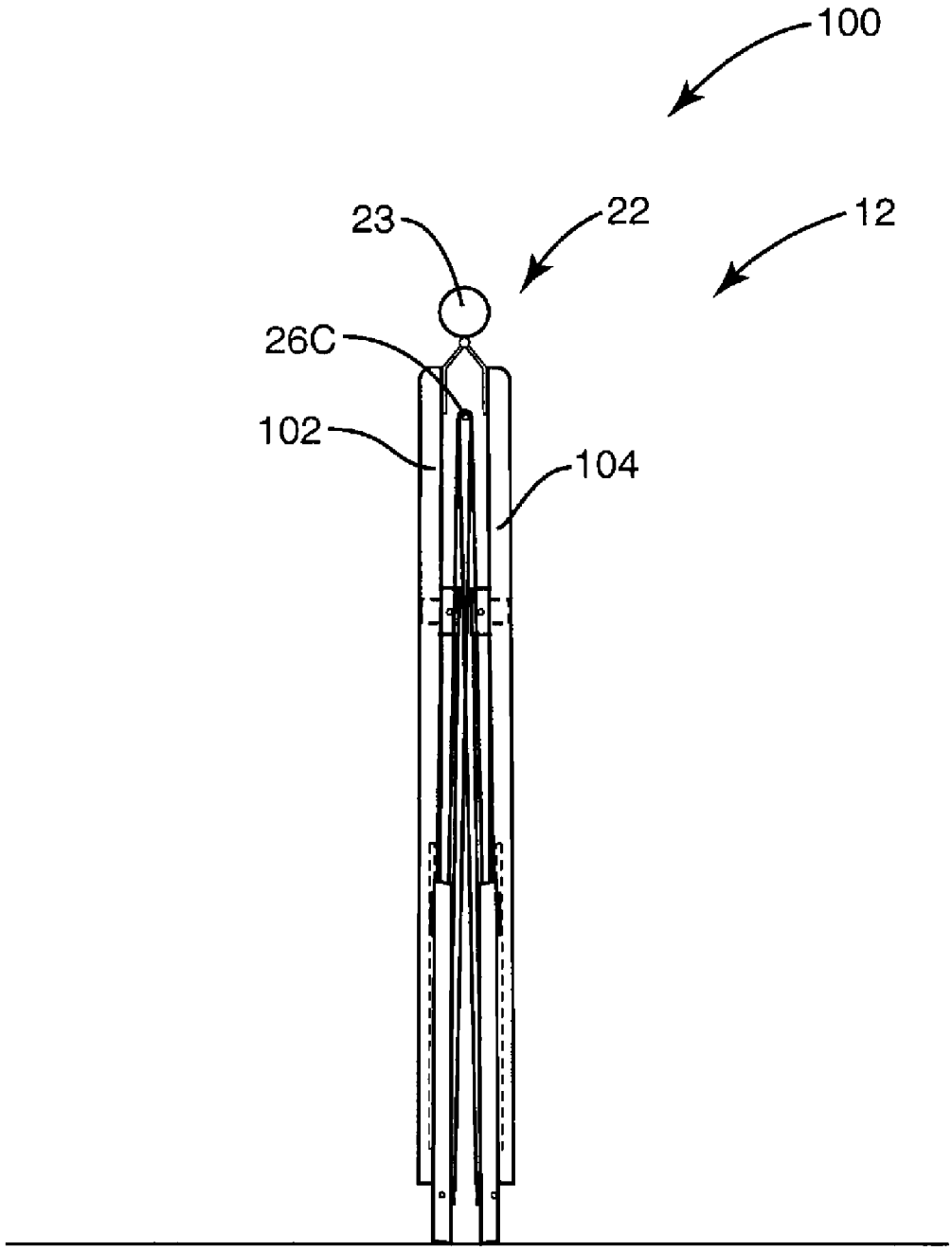

Turning to FIGS. 6-11, a second embodiment for the present invention is shown therein and indicated generally by the numeral 100. Foldable bench 100 includes many similarities of the foldable bench shown in FIGS. 1-5 and discussed herein above. One difference between the foldable bench 100 and the foldable bench shown in FIGS. 1-5, is that in the case of the foldable bench 100 the same can be transformed from an erect position as shown in FIG. 6 to a folded position as shown in FIG. 10 without having to disconnect components of the foldable bench. However, the foldable bench 100 may include components that would require disconnection prior to folding.

Figure 11:
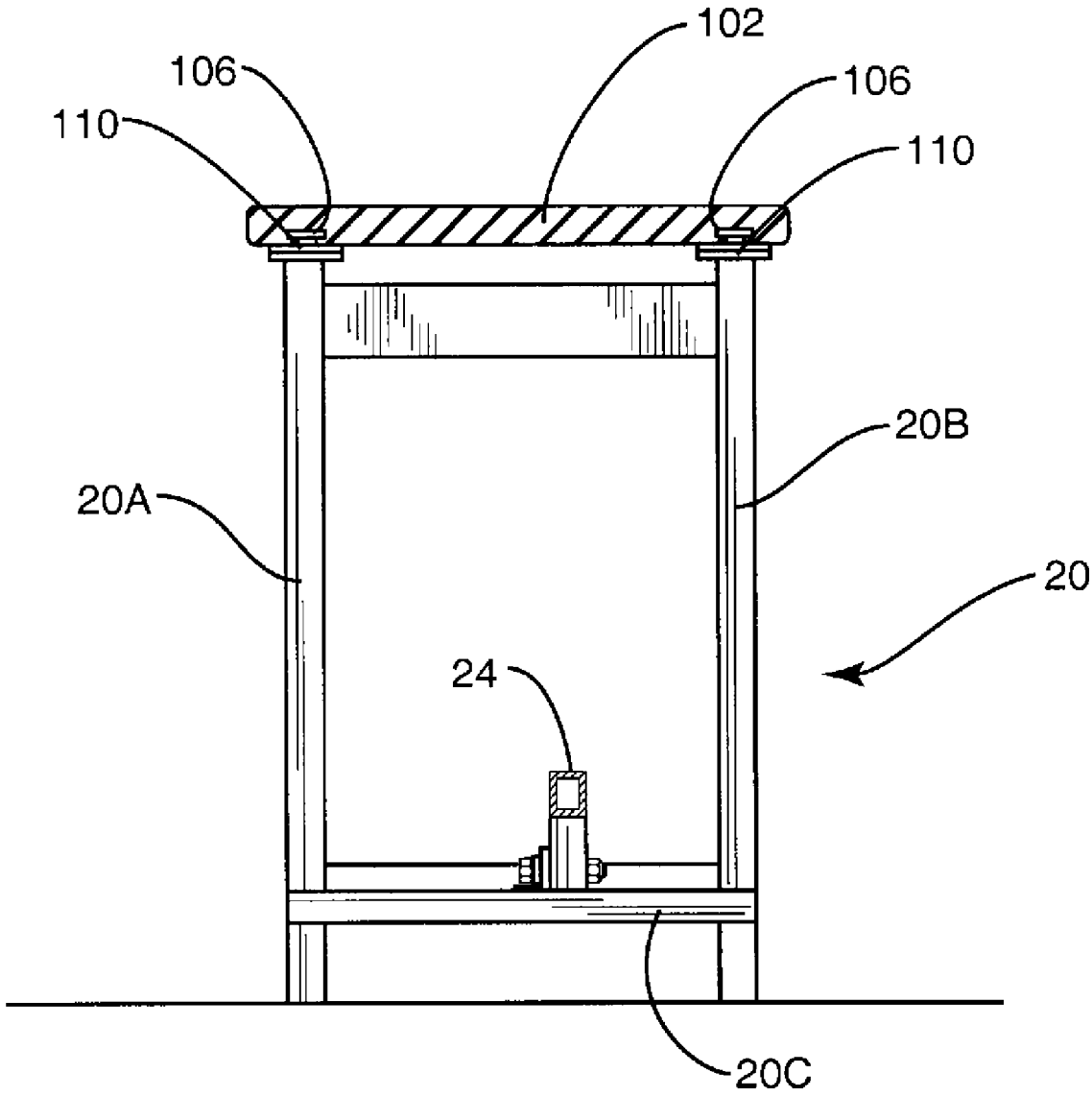
FIG. 11 is a transverse sectional view of the foldable bench shown in FIG. 6.

Turning to a discussion of the foldable bench 100, the same comprises a pair of seat sections indicated generally by the numeral 12. More particularly, the seat sections are referred to by numerals 102 and 104. A hinge or pivot pin assembly, indicated generally by the numeral 22, permits the pair of seat sections 102 and 104 to pivot or move towards each other. As seen in FIG. 6, the seat sections 102 and 104 are disposed in a horizontal or erect position. In this position the seat sections 102 and 104 function to support one or more individuals or other loads. In FIG. 11, the respective seat sections 102 and 104 have been folded together to where they assume a general parallel relationship.

Foldable bench 100 includes at least two leg assemblies 20. In the case of the design shown in FIGS. 6-11, there is provided a leg assembly about each end of the foldable bench 100. As will be appreciated from subsequent portions of the disclosure, each leg assembly is designed to both pivot with respect to a respective seat section 102 or 104, and slide or translates with respect to the same seat section. Each leg assembly 20 includes a pair of legs 20A and 20B and at least one cross section 20C. See FIG. 11.

Connected between each leg assembly 20 and a respective seat section 102 or 104 is a first connector or strut 24. In the case of the design shown herein, the first connector or strut 24 is pivotally connected at opposite ends to a leg assembly 20 and a respective seat section 102 or 104. When the foldable bench 100 is disposed in the erect position shown in FIG. 6 and a load is supported on the foldable bench, the first connectors or struts 24 are maintained in compression.

A second connector indicated generally by the numeral 26 extends between the leg assemblies 20. Second connector 26 is pivotally connected at opposite ends to respective leg assemblies 20. As seen in the drawings, second connector 26 includes two sections, 26A and 26B. Sections 26A and 26B are pivotally connected together by pivot connection 26C. Thus, it is appreciated that sections 26A and 26B can pivot with respect to each other about the pivot connection 26C. And further, each section 26A can pivot with respect to a respective leg assembly 20.

Each leg assembly is connected to a respective seat section 102 or 104. There is provided at least one connecting point through which the leg assembly 20 connects to a respective seat section. This connecting point can slide back and forth in each seat section. Furthermore, the leg assembly depending downwardly from the connecting point can pivot with respect to the seat section from which it depends. More particularly, each leg assembly includes the pair of legs 20A and 20B with a lower cross member 20C extending between the legs. Secured to the upper portion of each leg of the leg assembly is a connector 110. In the case of the design shown herein, the connector is of a T-bar design and extends upwardly from the top portion of the respective legs that form parts of the leg assemblies. Formed in each seat section 102 or 104 is a pair of tracks 106. The tracks 106 extend in parallel relationship from a terminal end portion of each seat section to an intermediate portion. The top portion of the connector 110 is confined within a respective track 106. As discussed above, the connector 110 in this case includes a T-bar and the upper portion of the T-bar is confined within a respective track 106. Furthermore, as discussed above, the legs that form a part of the leg assemblies 20 are pivotally connected to the connector 110 such that not only can the legs move back and forth within the track, but the legs can also pivot and rotate with respect to the respective seat sections.

In FIG. 6, the foldable bench 100 is shown in the erect position. Note that the seat sections 102 and 104 are disposed in a generally horizontal relationship. Each leg assembly 20, as discussed with respect to the embodiment shown in FIGS. 1-5, is disposed at a slight angle with respect to the seat sections 102 and 104. That is, the leg assemblies 20 extend generally downwardly and slightly inwardly. First connectors or struts 24 extend diagonally between a respective seat section 102 or 104 and a respective leg assembly 20. These connectors or struts 24 are held in compression when a load is placed on the foldable bench 100. The second connector 26 is held in tension when a load is placed on the foldable bench 100.

Figure 7:
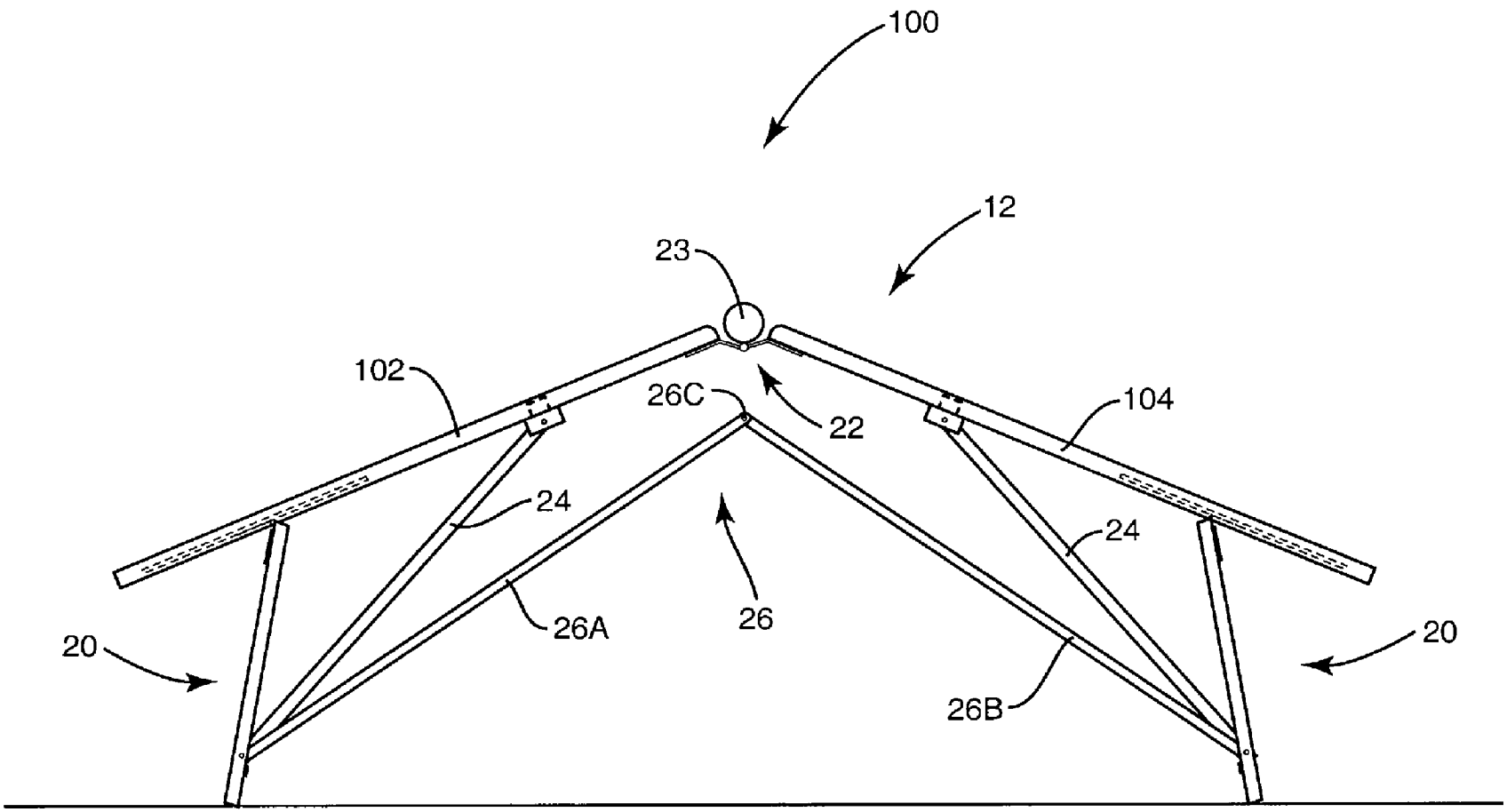
FIGS. 7-10 are a sequence of side elevational views showing the foldable bench being folded from an erect position to a folded position.

To transform the foldable bench 100 to a folded position, as shown in FIG. 10, the seat sections 102 and 104 are folded towards each other as shown in FIGS. 7-9. By pulling up on the bench and the second connector 26 enables the seat sections 102 and 104 to start to pivot or move towards each other. That is, by pulling up on the foldable bench on an area close to the hinge or pivot assembly 22, while also pulling up on the pivot connection 26C, allows the entire foldable bench 100 to begin its transformation towards the folded position as illustrated in FIG. 7. As the foldable bench is folded, the leg assemblies 20 tend to rotate inwardly. Then, as the folding procedure continues, the upper portions of the leg assemblies 20 are moved inwardly with respect to the seat sections 102 and 104. This is achieved by sliding the connectors 110 in the tracks 106 of the seat sections. This is continued, as illustrated in FIGS. 8 and 9, until the various components including the leg assemblies 20, first connectors 24 and the second connector 26 assumes the configuration shown in FIG. 9. From this configuration, the two seat sections 102 and 104 can be continued to be folded such that these components find themselves generally sandwiched between the folded seat sections 102 and 104. Note in the folded position, FIG. 10, that the seat sections 102 and 104 extend generally parallel while the leg assemblies 20, first connectors 24 and the second connector 26 are sandwiched therebetween.

It follows that the foldable bench can be transformed from the folded position shown in FIG. 11 to the erect position shown in FIG. 6 by simply reversing the operation and procedure just described.

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

The invention claimed is:

1. A foldable bench comprising:

a. at least two seat sections wherein the seat sections are movable between an extended position and a folded position;

b. at least two legs connected to the seat sections and movable between a folded position and an extended position;

c. wherein each leg includes a portion that connects to a respective seat section and moves back and forth with respect to the seat section;

d. a pair of first connectors connecting respective seat sections to respective legs;

e. a second connector for connecting the two legs; and f. wherein when the bench supports a load, the first connectors are in compression and the second connector is in tension.

2. The foldable bench of claim 1 wherein the portion of each leg that connects to a respective seat section moves back and forth within a track.

3. The foldable bench of claim 1 wherein the portion of each leg that connects to a respective seat section slides back and forth with respect to the seat section as the legs move between the folded and extended positions.

4. A foldable bench comprising:

a. at least two seat sections wherein the seat sections are movable between an extended position and a folded position;

b. at least two legs connected to the seat sections and movable between a folded position and an extended position;

c. wherein each leg includes a portion that connects to a respective seat section and moves back and forth with respect to the seat section;

d. a pair of first connectors connecting respective seat sections to respective legs;

e. a second connector for connecting the two legs; and f. wherein the second connector includes a rigid member having two sections interconnected by a pivot connection.

5. A foldable bench comprising:

a. at least two seat sections wherein the seat sections are movable between an extended position and a folded position;

b. at least two legs connected to the seat sections and movable between a folded position and an extended position;

c. wherein each leg includes a portion that connects to a respective seat section and moves back and forth with respect to the seat section;

d. a pair of first connectors connecting respective seat sections to respective legs;

e. a second connector for connecting the two legs; and f. wherein the seat sections are pivotably connected together;

g. the second connector including two generally rigid sections pivotably connected to gather, and wherein the two sections are movable between an extended and folded position; and h. wherein when the bench assumes a folded position, the legs, first connectors, and the pair of sections forming the second connector are at least partially sandwiched between the two seat sections.

6. A foldable bench comprising:

a. at least two seat sections wherein the seat sections are movable between an extended position and a folded position;

b. at least two legs connected to the seat sections and movable between a folded position and an extended position;

c. wherein each leg includes a portion that connects to a respective seat section and moves back and forth with respect to the seat section;

d. a pair of first connectors connecting respective seat sections to respective legs;

e. a second connector for connecting the two legs;

f. wherein each seat section includes a track and wherein each of the two legs includes a leg connector confined in the track and movable back and forth between at least two positions in the track;

g. wherein in the extended position the leg connector is disposed in one position in the track, and in the folded position the leg connector is disposed in another position in the track; and h. wherein each of the first connectors is pivotally connected at one end to one seat section and the other end to one leg.

* * * * *